US005895148A

United States Patent [19]

Levy et al.

[11] Patent Number: 5,895,148

[45] Date of Patent: Apr. 20, 1999

[54] CONTROL OF FLUID CARRIER RESISTANCE AND WATER CONCENTRATION IN AN AQUATRON CHARGING DEVICE

[75] Inventors: Michael J. Levy; John S. Facci, both of Webster; Richard B. Lewis, Williamson, all of N.Y.

[73] Assignee: Xerox Corporation, Stamford, Conn.

[21] Appl. No.: 08/974,663

[22] Filed: Nov. 19, 1997

[51] Int. Cl.[6] ..... G03G 15/02

[52] U.S. Cl. ..... 399/174; 399/50

[58] Field of Search ..... 399/174, 175, 399/176, 130, 168, 239, 240, 341, 342, 50; 361/225, 226

[56] References Cited

U.S. PATENT DOCUMENTS 5,264,899 11/1993 Mandel ..... 399/341
5,424,813 6/1995 Schlueter, Jr. et al. ..... 399/239
5,457,523 10/1995 Facci et al. ..... 399/168
5,493,369 2/1996 Sypula et al. ..... 399/240
5,510,879 4/1996 Facci et al. ..... 399/168
5,602,626 2/1997 Facci et al. ..... 399/135
5,708,937 1/1998 Lestrange et al. ..... 399/239

*Primary Examiner*—Sandra Brase
*Assistant Examiner*—Hoan Tran

[57] ABSTRACT

An apparatus and method that insures an even distribution of liquid in an aquatron charging device across the entire length of the device. This enables uniform charging across the width of the photoreceptor. The present invention fills and pressurizes a porous tube with a liquid. The liquid evenly exudes from the pores along the entire length of the porous tube. A hydrophilic liquid retentive foam which contacts the photoreceptor surface is wrapped snugly around the tube. The conductivity and overall rate of dispensation of liquid is controlled by the pressure differential across the porous tube.

15 Claims, 2 Drawing Sheets

CONTROL OF FLUID CARRIER RESISTANCE AND WATER CONCENTRATION IN AN AQUATRON CHARGING DEVICE

CROSS-REFERENCE

Cross-reference is made to and priority is claimed from U.S. patent application Ser. No. 08/974,098 (Attorney's Docket No. 97183) entitled "Roll Charger with Semi-Permeable Membrane for Liquid Charging" by Facci et al., U.S. patent application Ser. No. 08/974,097 (Attorney's Docket No. D/97185) entitled "Web Liquid Charging: Improved Resistance To Contamination" by Facci et al., and U.S. patent application Ser. No. 08/974,099 (Attorney's Docket No. D/97192) entitled "Control of Fluid Carrier Resistance and Liquid Concentration in an Aquatron Charging Device" by Facci et al., each assigned to the same assignee as the present application.

This invention relates generally to an electrostatographic printer and copier, and more particularly, concerns an apparatus for enabling ion transfer via ionic conduction through an ionically conductive liquid, primarily for use in electrostatographic applications, for example, for charging an imaging member such as a photoreceptor or a dielectric charge receptor.

BACKGROUND OF THE INVENTION

Liquid (e.g. aquatron) charging is an ozone-free contact charging technique that is based on the electrification of a water contact to the photoreceptor surface. It is advantaged over other contact charging techniques in that it provides excellent charging uniformity over a wide range of process speeds, e.g. to 50 ips, using a DC-only voltage. Furthermore, it is nearly 100% efficient, operating at near theoretical voltage and current levels. However, in order to obtain excellent charging uniformity over a long period of time, it is necessary to insure a uniform delivery of liquid, typically water to the aquatron contact to the photoreceptor in a practical and efficient manner.

The following disclosures may be relevant to various aspects of the present invention and may be briefly summarized as follows:

U.S. Pat. No. 5,602,626 to Facci et al. discloses an apparatus for applying an electrical charge to a charge retentive surface by transporting ions through an ionically conductive liquid and transferring the ions to the member to be charged across the liquid/charge retentive surface interface. The ionically conductive liquid is contacted with the charge retentive surface for depositing ions onto the charge retentive surface via a wetted donor blade supported within a conductive housing, wherein the housing is coupled to an electrical power supply for applying an electrical potential to the ionically conductive liquid. In one specific embodiment, the charging apparatus includes a support blade for urging the donor blade into contact with the charge retentive surface and a wiping blade for wiping any liquid from the surface of the charge retentive surface as may have been transferred to the surface at the donor blade/charge retentive surface interface.

U.S. Pat. No. 5,510,879 to Facci et al. discloses a process for charging layered imaging members by the transfer of ions thereto from an ionically conductive medium.

U.S. Pat. No. 5,457,523 to Facci et al. discloses a device for applying an electrical charge to a charge retentive surface by transporting ions in a fluid media and transferring the ions to the member to be charged across the fluid media/charge retentive surface interface. The fluid media is positioned in contact with a charge retentive surface for depositing ions onto the charge retentive surface. In one specific embodiment, the fluid media is a ferrofluid material wherein a magnet is utilized to control the position of the fluid media, which, in turn, can be utilized to selectively control the activation of the charging process.

SUMMARY OF INVENTION

Briefly stated, and in accordance with one aspect of the present invention, there is provided an apparatus for applying an electrical charge to an imaging surface, comprising: a fluid carrier being in adjacent proximity of the imaging surface to provide a charge thereto; means for supplying fluid to said fluid carrier; and a uniform fluid distribution member for application of the fluid to said fluid carrier.

Pursuant to another aspect of the present invention, there is provided a method for controlling resistance during charging an imaging surface, comprising: supplying fluid to a fluid carrier in adjacent proximity to the imaging surface for charging; sensing electrically an actual moisture level of fluid in the fluid carrier; and distributing the fluid uniformly to the fluid carrier, the fluid carrier having contact with the imaging surface for charging of the imaging surface.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 2:
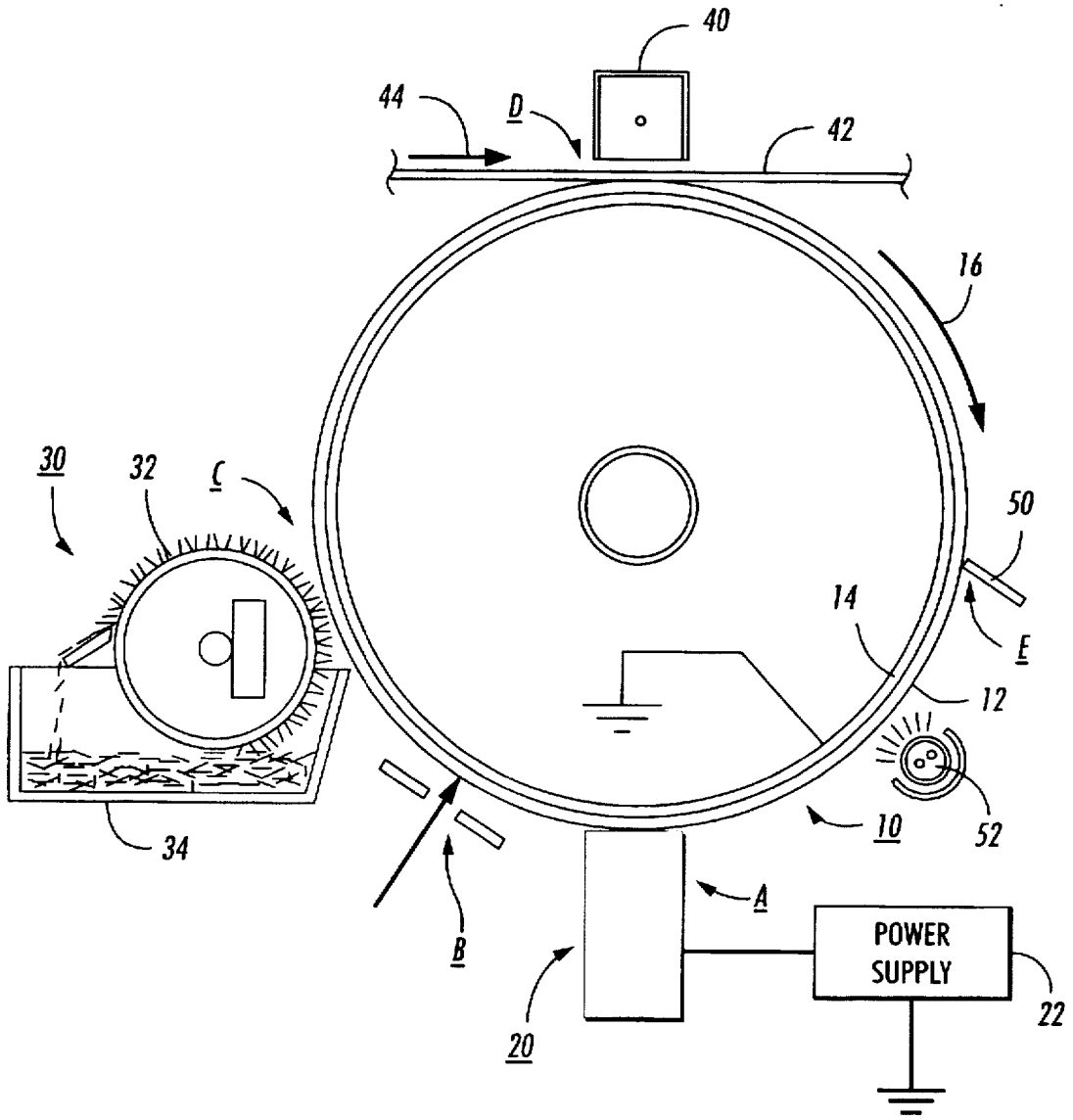
FIG. 2 is a schematic elevational view showing an electrophotographic copier employing the features of the present invention.

For a general understanding of the features of the present invention, reference is made to the drawings wherein like reference numerals have been used throughout to designate identical elements. Referring initially to FIG. 2 prior to describing the invention in detail, a schematic depiction of the various components of an exemplary electrophotographic reproducing apparatus incorporating the fluid media charging structure of the present invention is provided. Although the apparatus of the present invention is particularly well adapted for use in an automatic electrophotographic reproducing machine, it will become apparent from the following discussion that the present fluid media charging structure is equally well suited for use in a wide variety of electrostatographic processing machines and is not necessarily limited in its application to the particular embodiment or embodiments shown herein. In particular, it should be noted that the charging apparatus of the present invention, described hereinafter with reference to an exemplary charging system, may also be used in a transfer, detack, or cleaning subsystem of a typical electrostatographic apparatus since such subsystems also require the use of a charging device.

The exemplary electrophotographic reproducing apparatus of FIG. 2 employs a drum 10 including a photoconductive surface 12 deposited on an electrically grounded conductive substrate 14. A motor (not shown) engages with drum 10 for rotating the drum 10 to advance successive portions of photoconductive surface 12 in the direction of arrow 16 through various processing stations disposed about the path of movement thereof, as will be described.

Initially, a portion of drum 10 passes through charging station A. At charging station A, a charging structure in accordance with the present invention, indicated generally by reference numeral 20, charges the photoconductive surface 12 on drum 10 to a relatively high, substantially uniform potential. This charging device will be described in detail hereinbelow.

Once charged, the photoconductive surface 12 is advanced to imaging station B where an original document (not shown) is exposed to a light source for forming a light image of the original document which is focused onto the charged portion of photoconductive surface 12 to selectively dissipate the charge thereon, thereby recording an electrostatic latent image corresponding to the original document onto drum 10. One skilled in the art will appreciate that a properly modulated scanning beam of energy (e.g., a laser beam) may be used to irradiate the charged portion of the photoconductive surface 12 for recording the latent image thereon.

After the electrostatic latent image is recorded on photoconductive surface 12, drum 10 is advanced to development station C where a magnetic brush development system, indicated generally by the reference numeral 30, deposits developing material onto the electrostatic latent image. The magnetic brush development system 30 includes a single developer roller 32 disposed in developer housing 34. Toner particles are mixed with carrier beads in the developer housing 34, creating an electrostatic charge therebetween which causes the toner particles to cling to the carrier beads and form developing material. The developer roller 32 rotates to form a magnetic brush having carrier beads and toner particles magnetically attached thereto. As the magnetic brush rotates, developing material is brought into contact with the photoconductive surface 12 such that the latent image thereon attracts the toner particles of the developing material, forming a developed toner image on photoconductive surface 12. It will be understood by those of skill in the art that numerous types of development systems could be substituted for the magnetic brush development system shown herein.

After the toner particles have been deposited onto the electrostatic latent image for development thereof, drum 10 advances the developed image to transfer station D, where a sheet of support material 42 is moved into contact with the developed toner image via a sheet feeding apparatus (not shown). The sheet of support material 42 is directed into contact with photoconductive surface 12 of drum 10 in a timed sequence so that the developed image thereon contacts the advancing sheet of support material 42 at transfer station D. A charging device 40 is provided for creating an electrostatic charge on the backside of sheet 42 to aid in inducing the transfer of toner from the developed image on photoconductive surface 12 to a support substrate 42 such as a sheet of paper. While a conventional coronode device is shown as charge generating device 40, it will be understood that the fluid media charging device of the present invention can be substituted for the corona generating device 40 for providing the electrostatic charge which induces toner transfer to the support substrate materials 42. The support material 42 is subsequently transported in the direction of arrow 44 for placement onto a conveyor (not shown) which advances the sheet to a fusing station (not shown) which permanently affixes the transferred image to the support material 42 creating a copy or print for subsequent removal of the finished copy by an operator.

Invariably, after the support material 42 is separated from the photoconductive surface 12 of drum 10, some residual developing material remains adhered to the photoconductive surface 12. Thus, a final processing station, namely cleaning station E, is provided for removing residual toner particles from photoconductive surface 12 subsequent to separation of the support material 42 from drum 10. Cleaning station E can include various mechanisms, such as a simple blade 50, as shown, or a rotatably mounted fibrous brush (not shown) for physical engagement with photoconductive surface 12 to remove toner particles therefrom. Cleaning station E may also include a discharge lamp 52 for flooding the photoconductive surface 12 with light in order to dissipate any residual electrostatic charge remaining thereon in preparation for a subsequent imaging cycle. As will be described, the present invention may also be utilized as a substitute for such a discharge lamp to counter any residual electrostatic charge on the photoconductive surface 12.

The foregoing description should be sufficient for purposes of the present application for patent to illustrate the general operation of an electrophotographic reproducing apparatus incorporating the features of the present invention. As described, an electrophotographic reproducing apparatus may take the form of any of several well known devices or systems. Variations of the specific electrostatographic processing subsystems or processes described herein may be expected without affecting the operation of the present invention.

Liquid (e.g. aquatron) charging is an ozone-free contact charging technique that is based on the electrification of a water contact to the photoreceptor surface. Its advantage over other contact charging techniques is that it provides excellent charging uniformity over a wide range of process speeds, e.g. to 50 ips, using a DC-only voltage. Furthermore, it is nearly 100% efficient, operating at near theoretical voltage and current levels.

However, in order to obtain excellent charging uniformity over a long period of time, it is necessary to insure a uniform delivery of liquid, typically water to the aquatron contact to the photoreceptor in a practical and efficient manner. The present invention insures an even distribution of liquid in an aquatron charging device across the entire length of the device. By so doing, the concentration of liquid in the contact and hence the conductivity of the foam contact can be made uniform across the entire device. This enables uniform charging across the width of the photoreceptor.

Figure 1:
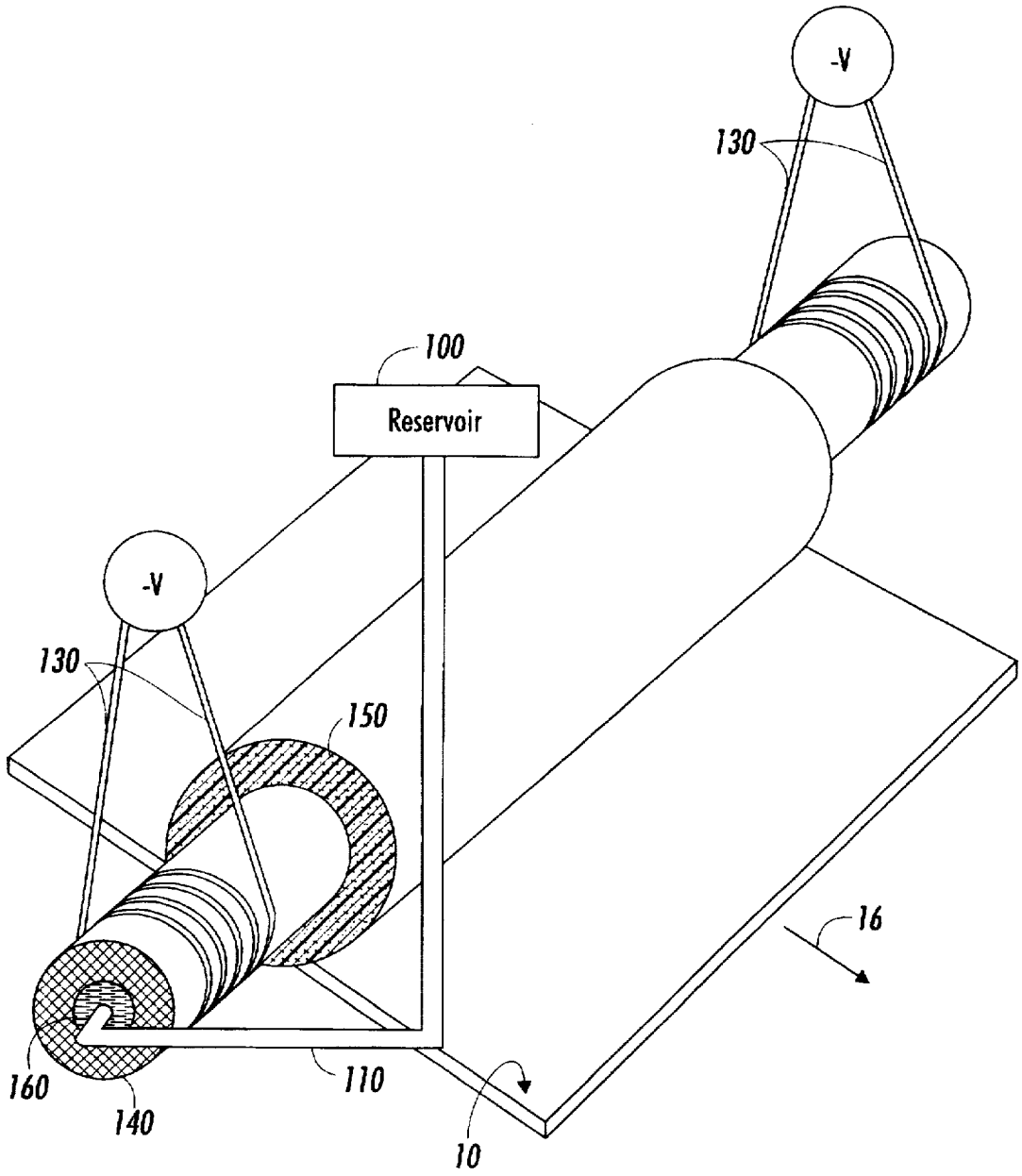
FIG. 1 is a schematic of an aquatron with a porous tube for even water distribution.

Reference is now made to FIG. 1, which shows schematically an embodiment of the present invention. The present invention obtains an even distribution of liquid in an aquatron contact to the photoreceptor (e.g. imaging surface) in order to maintain uniform conductivity and charging along the width of the photoreceptor. The present invention involves filling and pressurizing a porous (e.g. microporous) tube 140 with a liquid 160. The liquid 160 evenly exudes from the pores along the entire length of the porous tube 140. A hydrophilic liquid retentive foam 150 which contacts the photoreceptor surface is wrapped snugly around the tube 140. The conductivity of the liquid retentive foam 150 and overall rate of dispensation of liquid is controlled by the pressure differential across the porous tube 140.

As previously mentioned, the porous tube 140 is capable of uniformly exuding liquid through its pores along the entire length of the tube 140. Suitable materials for this porous tube 140 include plastic materials such as Teflon™ or sintered metals such as brass, stainless steel, copper, etc. The porous tube 140 is snugly covered by an open cell, liquid retentive foam 150 that pulls the liquid away from the porous tube 140 toward the photoreceptor 10. An effective foam layer material for the present invention includes a hydrophilic and non-abrasive material such as a formaldehyde crosslinked polyvinylalcohol (PVA) open cell foam. Note that the use of a hydrophobic tube is advantageous because when the pressure differential is removed, the liquid retracts from the porous opening back to the inside of the tube. Thus, eliminating the potential for the hydrophilic foam to wick the liquid away from the tube. This reduces liquid consumption, increases charging unit life, and improves the ability to maintain control over the liquid concentration in the foam. The foam thickness is preferably about 2 mm thick. (However, other foam thicknesses may be used.)

An example of covering the porous tube 140 "snugly" is to fasten the layer of foam 150 in place, by screws and a plate securely over the porous tube 140. (In this example, it is preferable that the foam thickness be approximately 2 mm thick. However, other foam thicknesses may be used.) Securing the foam 150 over the tube 140 in this manner, provides an ideal way of applying high voltage to the present invention. Two separate line wires 130 can be spirally wrapped over each end of the porous tube 140 prior to affixing the foam layer 150. These wires can then be used to apply high voltage and/or sensor voltages.

The rate of liquid transmission through the tube 140 is proportional to the pressure differential between the inner and outer surfaces of the tube. The total quantity of liquid released is proportional to the pressure differential multiplied by the time that the pressure differential is applied. Thus, the rate of liquid transmission is controlled by controlling the applied pressure, e.g. the pump pressure. Controlling the total quantity of liquid delivered controls both the on-time of a pump and the pump pressure.

The present invention may be operated in two modes. First, by adjusting the rate of liquid or water flow (e.g. pressure differential, pump on-time) into the porous tube 140 to match the rate of evaporation and transfer to the photoreceptor 10, it is possible to keep the foam 150 moistened with a constant concentration of water. Too high a concentration of water yields water spots on the print and poor image quality. Too low a concentration results in insufficient charging of the photoreceptor and image quality defects. The liquid or water is provided from a reservoir 100 via a conduit 110 to the porous tube 140.

Secondly, a more practical way of maintaining a constant level of liquid in the PVA foam involves the use of a sensor and pump arrangement in which the sensor measures the resistance of the foam and calls for the pump to supply liquid on an as needed basis, as described in an U.S. patent application Ser. No. 08/974,099 The use of a sufficiently high pressure differential and a relatively thin PVA foam results in a rapid response to the sensor's call for liquid. The wiring arrangement described above is amenable to both modes of operation.

To further disclose the present invention, some actual test examples are disclosed below:

Example I. A porous tube obtained from W. L Gore and Associates was used to uniformly distribute distilled water along the length of a charging pad. One end of the tube was sealed with epoxy and the other end was used as the entrance for water. A pump was used to achieve sufficient pressure (e.g. 10 psi) to force the water through the microscopic pores in the walls of the tubing. After achieving this pressure it was visually noted that the number of droplets on the tubing was uniform along the length of the tubing. A PVA foam charging pad was placed over the tubing and made to contact the photoreceptor. This device was used to make over 1000 prints in a Xerox 5065 printing machine operating in the discharge area development mode at 62 ips.

Example II. A woven material with the trade name "Baby Blanket," obtained from Pepperell Braiding Co. was placed adjacent to a 1/16 inch diameter Teflon tube containing collinear perforations spaced about 1 inch apart. When distilled water was pumped through these perforations, it impinged directly upon the "Baby Blanket" weave and it was visually noted that the water spread rapidly away from the perforations located behind the "Baby Blanket." Within several seconds the "Baby Blanket" was uniformly wet throughout. The latter in turn transfers water to an adjacent PVA (polyvinylalcohol ) foam charging pad uniformly enabling high quality prints to be made in a Xerox 4517 printer.

Example III. A 1/16 inch thick, 6 inch long and ¾ inch wide cellulose wick from American Filtrona Co. was mounted on the edge of a polycarbonate plastic plate support. A brass tube is located at one end of the wicking material such that a stream of distilled water impinged on one end of the wick. The fiber ends which were exposed at this end of the wick rapidly transported the water and within seconds the wick became uniformly wet. The long edge of the wick was coated using a PVA charging pad. A brass plate made electrical contact with the charging pad and also served to fasten the pad in place. A sheet of 2 mil thick aluminized Mylar was placed on a grounded aluminum drum and rotated at a constant process speed. A potential bias was applied to the brass plate and the insulated side of the Mylar belt was charged with to the applied voltage within one turn of the drum. The charge uniformity typically was plus or minus 2 volts.

In recapitulation, the present invention insures an even distribution of liquid in an aquatron charging device across the entire length of the device. This enables uniform charging across the width of the photoreceptor. The present invention fills and pressurizes a porous tube with a liquid. The liquid evenly exudes from the pores along the entire length of the porous tube. A hydrophilic liquid retentive foam which contacts the photoreceptor surface is wrapped snugly around the tube. The conductivity and overall rate of dispensation of liquid is controlled by the pressure differential across the porous tube.

It is, therefore, apparent that there has been provided in accordance with the present invention, even distribution of liquid in an aquatron charging device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for applying an electrical charge to an imaging surface, comprising and aquatron charging device comprising:

a porous tube comprising pores located along a length of said porous tube, said porous tube containing a fluid carrier, and positioned on said porous tube, a foam layer being in adjacent proximity of the imaging surface to provide a charge thereto;

means for supplying fluid to said fluid carrier; wherein the fluid is pressurized in said porous tube so as to evenly exude from said pores, into said foam layer located in adjacent proximity to said porous tube, so as to supply an electric charge to said imaging surface.

2. An apparatus as recited in claim 1, wherein said porous tube having a pressure differential across said porous tube to control conductivity and rate of dispensation of the fluid.

3. The apparatus as recited in claim 1, wherein said fluid is water.

4. The apparatus as recited in claim 1, wherein said foam layer comprises a hydrophilic liquid retentive foam.

5. The apparatus as recited in claim 4, wherein said hydrophilic liquid retentive foam is formaldehydr crosslinked polyvinylalcohol.

6. The apparatus as recited in claim 1, wherein said porous tube comprises a material selected from the group consisting of plastic and sintered metal.

7. The apparatus as recited in claim 6, wherein said sintered metal is selected from the group consisting of brass, stainless steel and copper.

8. The apparatus as recited in claim 1, wherein said foam layer has a thickness of about 2 mm.

9. The apparatus as recited in claim 1, wherein said porous tube comprises fine wires spirally wrapped over said porous tube.

10. The apparatus as recited in claim 9, wherein a voltage is applied to said fine wires.

11. The apparatus as recited in claim 1, wherein said pressure is at a force of about 10 psi.

12. The apparatus as recited in claim 1, wherein said pores are spaced about 1 inch apart.

13. A method for controlling resistance during charging an imaging surface, comprising:

supplying fluid to a fluid carrier in adjacent proximity to the imaging surface for charging;

sensing electrically an actual moisture level of fluid in the fluid carrier; and distributing the fluid uniformly to the fluid carrier, the fluid carrier having contact with the imaging surface for charging of the imaging surface.

14. A method as recited in claim 13, wherein the distributing step comprises a porous tube having a pressure differential across the porous tube to control conductivity and rate of dispensation of the fluid.

15. A method as recited in claim 13, wherein the distributing step comprises a wicking material that draws fluid away from a fluid supply providing a spatially uniform supply of water to the fluid carrier.

* * * * *